United States Patent [19]

Itoh et al.

[11] Patent Number: 4,658,950

[45] Date of Patent: Apr. 21, 1987

[54] LIFT APPARATUS FOR LIFTING CIGARETTE FILTER PLUGS

[75] Inventors: Kenkichi Itoh, Kobe; Takao Matsui; Toshio Murakami, both of Osaka, all of Japan

[73] Assignees: Osaka Filter Co., Ltd., Sakai; Needs Kiko Co., Ltd., Moriguchi, both of Japan

[21] Appl. No.: 803,776

[22] Filed: Nov. 29, 1985

Related U.S. Application Data

[63] Continuation of Ser. No. 539,958, Oct. 7, 1983, abandoned.

[51] Int. Cl.[4] ..... B65G 37/00

[52] U.S. Cl. ..... 198/577; 198/604; 198/607; 198/626

[58] Field of Search ..... 198/626–628, 198/347, 606, 604, 572, 607, 577; 131/282, 283

[56] References Cited

U.S. PATENT DOCUMENTS

| | | | |
|---|---|---|---|
| 3,749,326 | 7/1973 | Aro | 198/569 |
| 4,120,391 | 10/1978 | Molins et al. | 198/347 |
| 4,280,611 | 7/1981 | Molins et al. | 198/572 |
| 4,339,025 | 7/1982 | McCombie | 198/347 |
| 4,350,242 | 9/1982 | Hinchcliffe et al. | 198/626 |
| 4,366,895 | 1/1983 | Bennett et al. | 198/347 |

FOREIGN PATENT DOCUMENTS

| | | |
|---|---|---|
| 1432713 | 3/1964 | Fed. Rep. of Germany . |
| 2366162 | 10/1973 | Fed. Rep. of Germany . |
| 2755599 | 12/1977 | Fed. Rep. of Germany . |
| 46-1199 | 1/1971 | Japan . |
| 50-10960 | 4/1975 | Japan . |
| 56-31947 | 7/1981 | Japan . |

*Primary Examiner*—Joseph E. Valenza

*Attorney, Agent, or Firm*—Wenderoth, Lind & Ponack

[57] ABSTRACT

A lift apparatus for lifting cigarette filter plugs which receives cigarette filter plugs fresh from a plug making machine and delivered by a lower horizontal conveyer and upwardly conveys the plugs while piled in multiple layers to an upper horizontal conveyer. The lift apparatus has a pair of vertical conveyers formed of flat belts and diverging as they extend upwardly. A pressurizing conveyer is provided outwardly of a bend in the conveying passage extending from the lower horizontal conveyer to the vertical conveyers. This pressurizing conveyer is rotatable at a greater speed than the vertical conveyers.

4 Claims, 4 Drawing Figures

LIFT APPARATUS FOR LIFTING CIGARETTE FILTER PLUGS

This application is a continuation of now abandoned application Ser. No. 539,958, filed Oct. 7, 1983.

BACKGROUND OF THE INVENTION

1. Field of the Invention

This invention relates to a lift apparatus for lifting cigarette filter plugs which receives cigarette filter plugs (which are cylindrical rods about 100 mm long to be cut into pieces of a certain length for attachment to cigarettes) fresh from a plug making machine and delivered by a lower horizontal conveyer and conveys the plugs upwardly while as piled in multiple layers to an upper horizontal conveyer.

2. Description of the Prior Art

Generally it is possible in lifting cigarettes from a lower position to a higher position, as seen from Japanese Patent Publication No. 50-10960, to lift the cigarettes by using a parallel pair of vertical conveyers comprising flat belts. In such a prior art construction, a large amount of cigarettes delivered to a bottom portion between the two vertical conveyers is lifted while piled to form layers of a certain thickness between the parallel vertical conveyers. However, where products to be lifted are cigarette filter plugs, those plugs lying centrally of the multilayer pile tend to slip downwardly. It is difficult to carry out efficient lifting of the plugs in multiple layers although the plugs are bar-like products similar to cigarettes in diameter and length. This is due to the following reasons:

Firstly, each plug is produced in the form of a cylindrical rod or bar comprising acetate filter fibers entangled with one another with spot joints formed at contracting paints by softening the fibers with a solvent such as triacetin or the like, with paper rolled around the plug. The fibers softened by the solvent start curing in four or five minutes and cure to a stable hardness after one and one half hours or two hours. Therefore, the plugs immediately after leaving the plug making machine are usually very soft. If such plugs are lifted over a long distance under a strong compacting pressure from both sides imparted by the two parallel vertical conveyers, the plugs will cure in the deformed condition under pressure, which results in intolerable deviations from a truly circular cross-sectional shape. Therefore, the two vertical conveyers cannot have a space therebetween much smaller than the thickness of the plugs in multiple layers nor can they exert a great pinching force on the plugs.

Secondly, the paper rolled around the rod-like filter material is in many instances considerably slicker than the paper material used for cigarettes, and frictional engagements among the plugs are very weak.

For the above reasons it is difficult to lift the fresh made cigarette filter plugs in multiple layers by means of a parallel pair of vertical conveyers comprising flat belts.

Other examples of lift means have been proposed for lifting bar-shaped products such as cigarettes in multiple layers. One of them is shown in Japanese Patent Publication No. 56-31947 in which a parallel pair of vertical conveyers includes a plurality of projections having a triangular cross section attached to the belt surfaces. Another is shown in Japanese Patent Publication No. 46-1199 in which the vertical conveyers comprise porous belts backed by suction boxes. However, the former involves possibility of deforming the plugs with the projections, and the latter has disadvantages of a complicated construction and difficulty in controlling the conveying speed and degree of vaccuum in the suction boxes.

For these reasons, therefore, plugs are lifted in a single layer (namely in a row) on vertical conveyers in filter manufacturing plants today.

SUMMARY OF THE INVENTION

A lift apparatus for lifting cigarette filter plugs according to this invention has been developed having regard to the above noted state of the art. The object of this invention is to provide such a lift apparatus that has a very simple construction comprising a pair of vertical conveyers including no projections on belt surfaces to engage the plugs and no suction boxes behind the belts to draw the plugs against the belts, and is yet capable of lifting multiple layers of plugs fresh from a plug making machine in a reliable manner and without permitting the plugs to cure in deformed shapes under pressure between the vertical conveyers.

In order to achieve this object, the lift apparatus for lifting cigarette filter plugs according to this invention is characterized in that a pair of non-parallel vertical conveyers comprising flat belts is disposed between the upper and lower horizontal conveyers to define a lifting passage flaring as the same extends upwardly, and a pressurizing conveyer is disposed at a bend in a conveying passage extending from a horizontal conveying passage defined by the lower horizontal conveyer to the lifting passage, the pressurizing conveyer comprising a flat belt rotatable along an outer side of the bend in a conveying passage and at a greater speed than the vertical conveyers.

Since the pressurizing conveyer rotatable at a greater speed than the vertical conveyers is provided along the outer side of the bend in the conveying passage extending from the horizontal conveying passage defined by the lower horizontal conveyer to the lifting passage defined by the pair of vertical conveyers, the plugs are delivered to the lifting passage between the vertical conveyers by this pressurizing conveyer under pressure due to the speed difference between the pressurizing conveyer and the vertical conveyers. Thus there occurs no downward slippage of the plugs lying centrally of the layers inside the lifting passage, and a great amount of plugs are reliably lifted while piled in multiple layers. Furthermore, there is no likehihood of the fresh made plugs curing into deformed shapes under the pressure since the vertical conveyers are in such a non-parallel arrangement that the vertical conveyers grow farther apart from each other as they extend upwardly whereby the plugs are released from the pressurized condition progressively as the plugs are lifted upward. Moreover, the vertical conveyers and the pressurizing conveyer according to this invention all comprise flat belts in contrast with the prior art examples as set out in the introductory part hereof, and therefore this construction is free from the problem of deforming the plugs with projections provided on the belt surfaces and has an advantage of simple construction requiring no suction boxes.

According to one embodiment of this invention the rotational speed difference between the pressurizing conveyer and the vertical conveyers is made variable. This construction permits the rotational speed difference to be changed or set as desired, whereby an optimum pressure is always applied to the plugs to enable a reliable lifting regardless of changes in the type of plug or other, changes in conditions.

Other objects and advantages of this invention will be apparent from the following description.

BRIEF DESCRIPTION OF THE DRAWINGS

The drawings show lift apparatus for lifting cigarette filter plugs according to this invention, in which.

DETAILED DESCRIPTION OF THE PREFERRED EMBODIMENT

Figure 1:
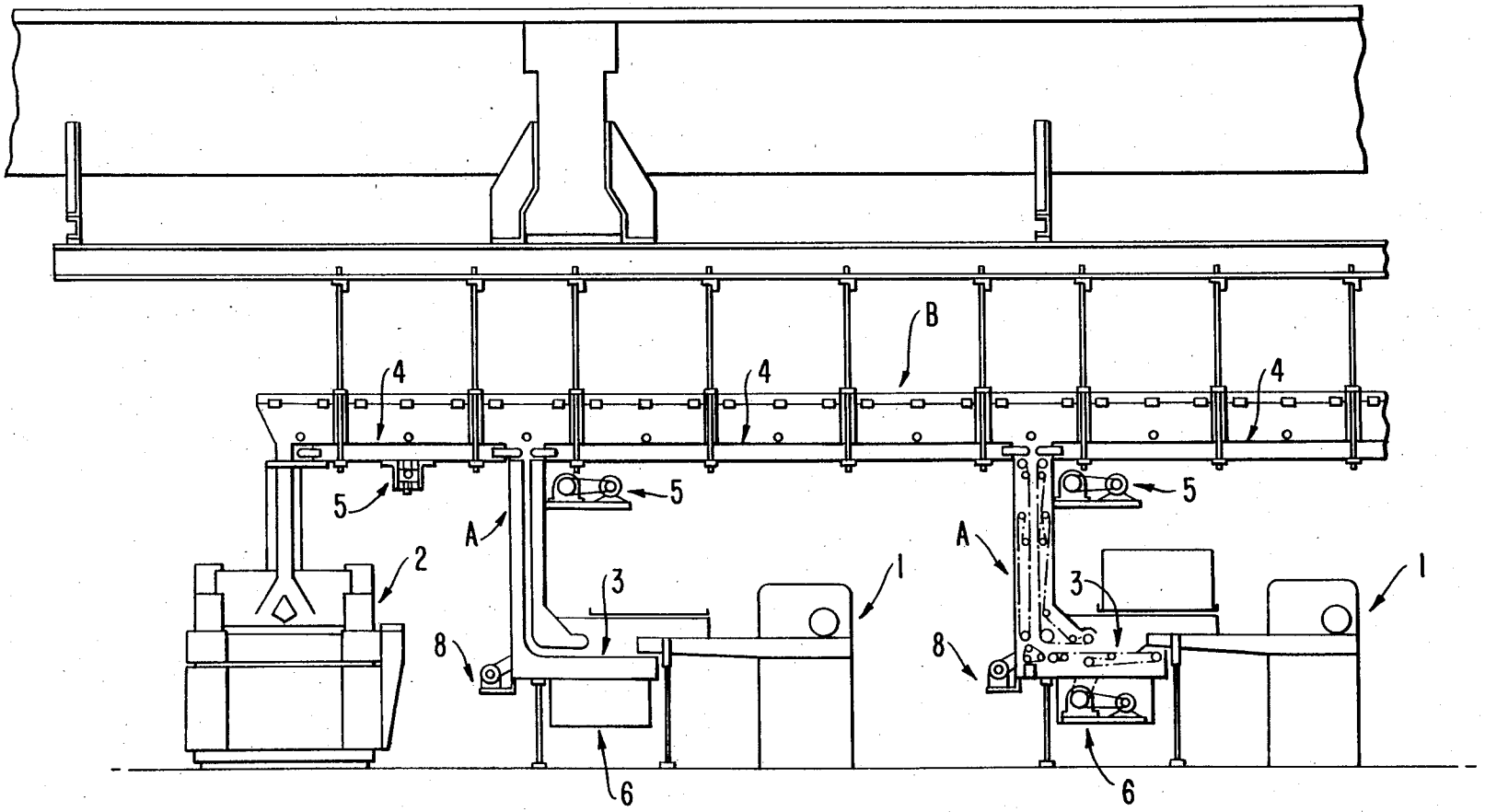
FIG. 1 is a front view of the apparatus.
Figure 2:
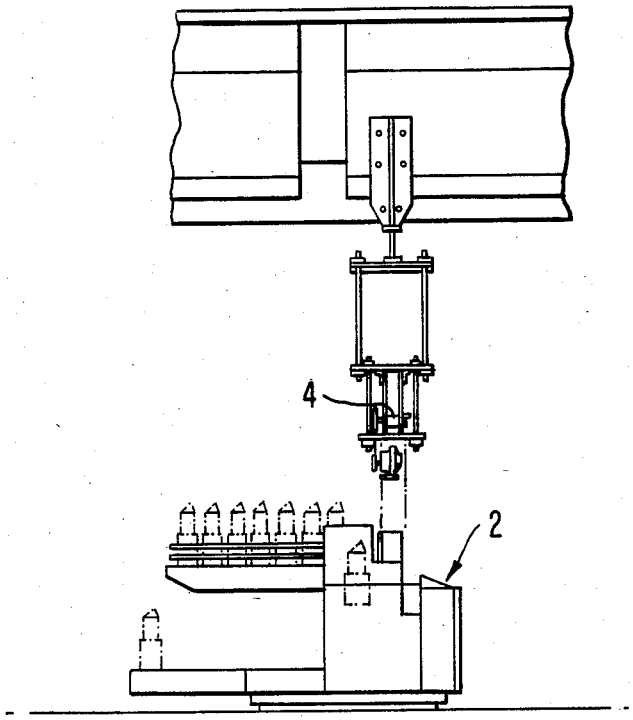
FIG. 2 is an end view of the apparatus.

FIGS. 1 and 2 show a system for conveying cigarette filter plugs made by a plurality of plug making machines 1 to an automatic packaging machine 2. Number 3 denotes a lower horizontal conveyer for conveying the plugs from each of the plug making machines 1. The plugs delivered by the lower horizontal conveyer 3 are lifted to an upper horizontal conveyer 4 by a cigarette filter plug lift apparatus A according to this invention. A plug storage chamber B is defined on the upper horizontal conveyers 4 to store the plugs arriving confluently from the respective plug lift apparatus A and also to serve as a horizontal passage. The plugs are continuously fed from a terminal end of the upper horizontal conveyers 4 to the automatic packaging machine 2. Number 5 denotes an upper horizontal conveyer drive means provided for each of the upper horizontal conveyers 4. Number 6 denotes a drive means for driving each of the lower horizontal conveyers 3 and a pair of vertical conveyers 7*a* and 7*b* to be described later, at the same speed. Number 8 denotes a drive means for a pressurizing conveyer 9 to be described later.

Figure 3:
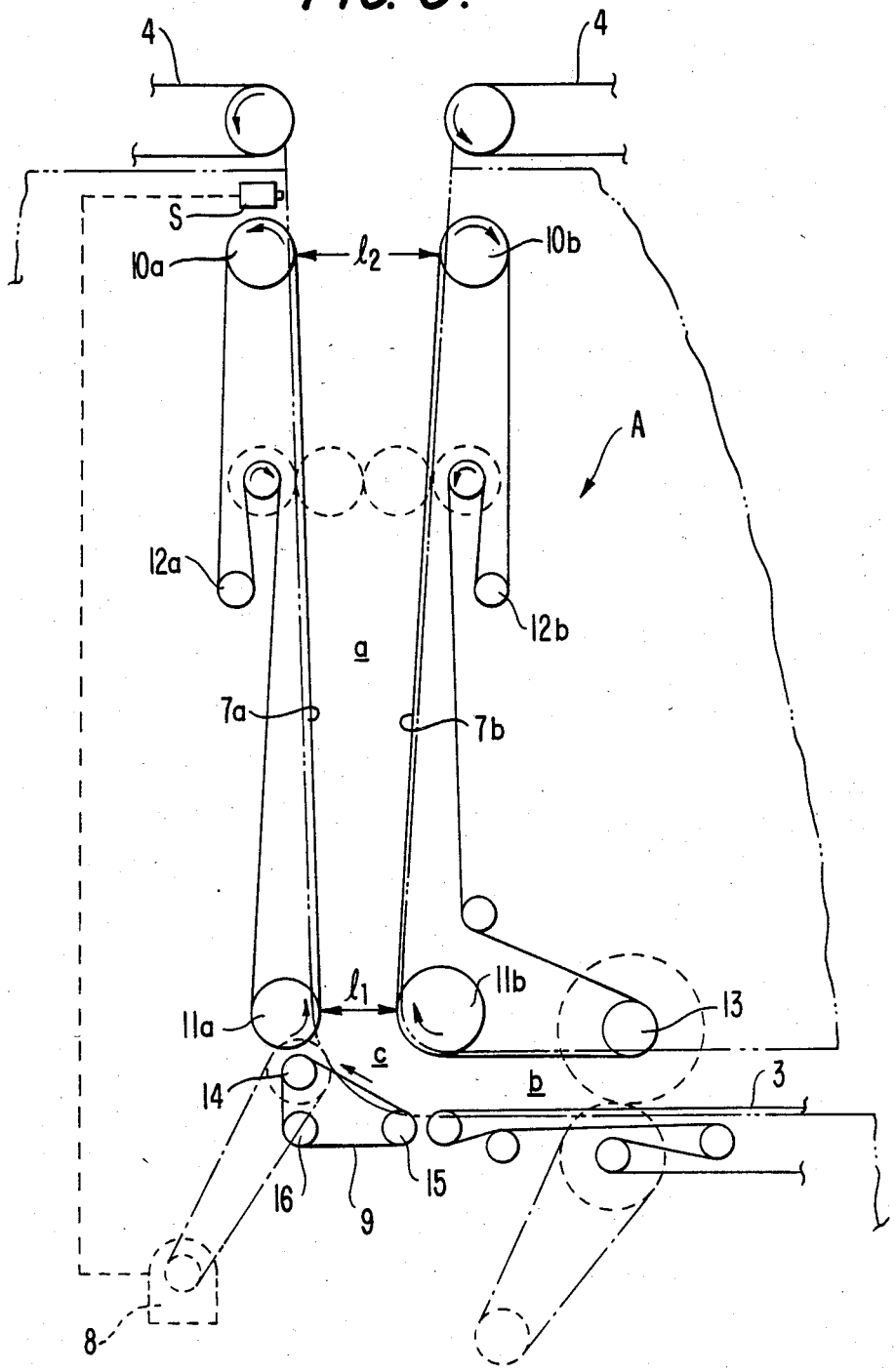
FIG. 3 is a diagrammatic enlarged front vertical section of a principal portion of the apparatus.

Details of the plug lift apparatus A are as follows:

As shown in FIG. 3, a pair of spaced opposed flat belts 7*a* and 7*b* are supported by upper pulleys 10*a* and 10*b* mounted adjacent the upper horizontal conveyers 4, lower pulleys 11*a* and 11*b* mounted adjacent the lower horizontal conveyer 3, and tension adjuster pulleys 12*a* and 12*b* mounted at vertically intermediate positions to be positionally adjustable. The two vertical conveyers 7*a* and 7*b* are not parallel to each other and define therebetween a lifting passage a flaring outwardly as its extends upwardly. Number 13 denotes a pulley to support a lower end of one of the vertical conveyers 7*b* parallel to the lower horizontal conveyer 3.

While the lifting passage a has widths variable as desired within the above "non-parallel" condition, in the case of a 1 meter lift range the lifting passage a desirably has a bottom width l1 in the order of 5 to 15 times a plug diameter and a top width l2 in the order of 1.5 to 3 times the bottom width l1.

A pressurizing conveyer 9 comprising a flat belt is mounted on a drive pulley 14, a follower pulley 15 and a tension adjuster pulley 16 and has a run movable along an outer side of a bend in conveying passage c extending from a horizontal conveying passage b defined by the lower horizontal conveyer 3 to the lifting passage a. The pressurizing conveyer 9 is driven by the drive means 8 so as to rotate at a higher speed in the direction shown by the arrow than the vertical conveyers 7*a* and 7*b*.

There are transparent plates provided at the forward and rearward ends (on both lateral sides of belts) of the lifting passage a, the horizontal conveying passage b, the bend in the conveying passage c, and the conveying passage along the upper horizontal conveyer 4, respectively, to permit visual inspection of how the plugs are conveyed.

According to the described construction, the plugs sent out in multiple layers by the lower horizontal conveyer 3 are delivered to the lifting passage a between the vertical conveyers 7*a* and 7*b* by the pressurizing conveyer 9. Because of the rotational speed of the pressurizing conveyer 9, that is to say because the plug conveying speed of the pressurizing conveyer 9 is faster than that of the vertical conveyers 7*a* and 7*b*, the difference in the two speeds produces pressure on the groups of plugs in the lifting passage a to maintain them in closely packed layers.

Since the lifting passage a flares outwardly as it extends upwardly, the groups of plugs are released from the pressurized condition as they advance upwardly. The pressurization continuously forms one closely packed group of plugs after another in multiple layers adjacent the lower end of the interior of the lifting passage a, and these closely packed groups of plugs prevent the plugs lying centrally or in intermediate positions of the layers from slipping down whereby the plugs are lifted to the upper horizontal conveyer 4.

To be specific, of the groups of plugs lifted while piled one on top of the other in multiple layers, those lying in intermediate positions of the layers which are not expected to benefit from frictional engagement with the flat belt surfaces of the vertical conveyers 7*a* and 7*b* would slip downwardly due to gravity unless supported by some means because bridging due to frictional engagements among the plugs themselves does not occur due to release of the pressurization. However, the above pressurization produces one group of plugs after another in closely packed multiple layers, and these groups of plugs serve as a kind of bottom member to support the upper groups of plugs, whereby the plugs are lifted in multiple layers in a positive manner without slipdown of the plugs lying in intermediate positions of the layers.

The fresh plugs taken out by the lower horizontal conveyer 3 do not have filter fibers cured to a stable hardness yet. However, the plugs are released, as they advance upward, from the pressure applied thereto in the lifting passage a adjacent the lower end as described above, that is to say the plugs are not advanced under the pressurized condition over the entire lift range by the vertical conveyers 7*a* and 7*b*. Therefore, the plugs will never cure into deformed shapes because of the pressure, and deviations from their circular cross-sectional shape are completely prevented.

Although the lifting passage a is made to flare outwardly in the upward direction by inclining both the conveying surface of the vertical conveyer 7*b* disposed upstream in the direction of conveyance by the upper horizontal conveyers 4 and the conveying surface of the other vertical conveyer 4*a* in the illustrated embodiment, the lifting passage a may be made to flare by erecting the conveying surface of one of the vertical conveyers 7*a* or 7*b* vertically and inclining only the conveying surface of the other vertical conveyer 7*a* or 7*b*. Furthermore, the invention may be practised by making the drive means 8 for the pressurizing conveyer 9 operable at different speeds and at the same time providing a sensor S at a suitable position such as at the top of the plug lift apparatus A to detect the amount of plugs being conveyed. Then an automatic control may be effected by changing the speed of the drive means 8 in response to detections by the sensor, thereby providing a speed difference between the pressurizing conveyer 9 and the vertical conveyers 7*a* and 7*b* to achieve conveyance of a constant amount.

Furthermore, the drawings show a plurality of the lift apparatus A interconnected by the upper horizontal conveyers 4 to facilitate efficient conveyance of the plugs while piled in multiple layers. Such an arrangement may have the following problem:

A first upper horizontal conveyer 4 which is installed the farthest from the automatic packaging machine 2 conveys only those plugs received from the lift apparatus disposed at the starting end of this upper horizontal conveyer 4. A second upper horizontal conveyer 4 receives the plugs from the first upper horizontal conveyer 4 in addition to the plugs delivered by the lift apparatus disposed at the starting end of this second upper horizontal conveyer 4. A third upper horizontal conveyer 4 receives the plugs from the second upper horizontal conveyer 4 in addition to the plugs delivered by the lift apparatus disposed at the starting end of the third upper horizontal conveyer 4. In this way, the amount of plug conveyance per unit time by the upper horizontal conveyers 4 gradually increases toward the end of conveyance.

Therefore, where a plug storage chamber B having a uniform vertical width over the entire length is provided upwardly of all of the upper horizontal conveyers 4, spaces therein become progressively superfluous as they lie farther away from the automatic packaging machine 2 and portions of the plug storage chamber B close to the automatic packaging machine 2 have to accommodate a great amount of plugs at all times.

Therefore, in the event that the automatic packaging machine 2 stops its operation for some reason or other, the portion of the plug storage chamber B above the upper horizontal chamber closest to the automatic packaging machine 2 becomes full up at once. Then it is necessary to stop this upper horizontal conveyer 4 and the lift apparatus A and the plug making machine 1 associated therewith, and to stop the next upper horizontal conveyers 4, the lift apparatus A and the plug making machines 1, one after the other upstream in the direction of conveyance within a short time.

Figure 4:
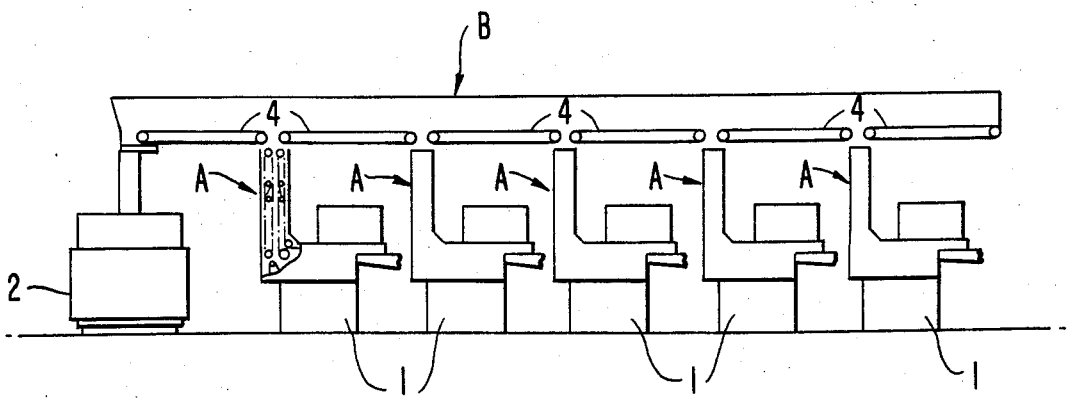
FIG. 4 is a schematic view showing one mode of application of the apparatus of FIGS. 1–3.

Such a problem may be solved by providing the following construction:

As schematically shown in FIG. 4, an entire conveying system comprises a plurality of sections arranged in row, each section including a plug making machine 1, a lift apparatus A and an upper horizontal conveyer 4. The plug storage chamber B is defined upwardly of and extending over all of the upper horizontal conveyers 4 including an additional conveyer 4' extending from the starting end of the upper horizontal conveyer 4 of the section farthermost from the automatic packaging machine 2, the additional conveyer 4' being switchable for forward and backward rotations. When the automatic packaging machine 2 goes out of operation for one reason or another, the upper horizontal conveyer 4 of the section closest to the automatic packaging machine 2 is kept in forward rotation, the additional upper horizontal conveyer 4' is kept in backward rotation, and all of the remaining upper horizontal conveyers 4 are repeatedly switched between forward rotation and backward rotation at certain intervals.

According to the above construction, since the direction of conveyance by all of the upper horizontal conveyers 4 except the upper horizontal conveyer 4 closest to the automatic packaging machine 2 and the additional upper horizontal conveyer 4' is switched backward and forward when the automatic packaging machine 2 is out of operation, the plugs are stored substantially uniformly over the entire area inside the plug storage chamber B, which solves the above noted noted problem.

The following tables show the performance of the above construction by using numerical values. In the tables, Nos. 1–9 are allotted to nine serially arranged upper horizontal conveyers 4 in the order starting with the conveyer closest to the automatic packaging machine 2 and No. a is allotted to the additional upper horizontal conveyer 4'. The arrows show the conveying directions of the conveyers Nos. 2–9, and the numerals show levels (or pile heights) of plugs on the respective upper horizontal conveyers.

It is supposed that now the nine lift apparatus A associated with the conveyers Nos. 1–9, respectively, are continuously lifting a certain amount of plugs corresponding to level 1 in a certain time t, and after the passage of the certain time t the plugs are stored on the conveyers Nos. 1–9 at levels 9–1.

As soon as the automatic packaging machine 2 stops operating, the conveyer No. a is put into backward rotation, and the conveyers Nos. 2–9 are put into backward rotation for the certain time t while the conveyer No. 1 is kept rotating forwardly. Then, the level 1 plugs stored on the conveyer No. 9 together with newly lifted level 1 plugs are sent onto the conveyer No. a, and so the conveyer No. a stores plugs at level 2. Similarly, the conveyer No. 9 stores plugs at level 3, the conveyer No. 8 plugs at level 4, No. 7 at level 5, No. 6 at level 6, No. 5 at level 7, No. 4 at level 8, No. 3 at level 9, and the conveyer No. 2 stores newly lifted plugs at level 1 only. Although rotating forwardly, the conveyer No. 1 keeps holding level 9 plugs without being able to send out the plugs because the automatic packaging machine 2 is out of operation (see second column of the table).

Subsequently, when the conveyers No. 2–9 are put into backward rotation, the level 1 plugs stored on the conveyer No. 2 together with newly lifted level 1 plugs are sent onto the conveyer No. 1, and so the conveyer No. 1 stores plugs at level 2. Similarly, the conveyer No. 2 stores plugs at level 10, the conveyer No. 3 at level 9, the conveyer No. 4 at level 8, No. 5 at level 7, No. 6 at level 6, No. 7 at level 5, No. 8 at level 4, and No. 9 stores newly lifted level 1 plugs only. The conveyer No. a keeps holding level 2 plugs (see third column of the table).

By repeating such a process, the plug levels on the conveyers Nos. 1–9 and No: a change as shown in the tables.

Assuming that level 25 is the limit, the conveyer No. 1 arrives at its full capacity in the certain time t multiplied by 17, and so the lift apparatus A and the plug making machine 1 associated with the conveyer No. 1 are stopped upon passage of 17 times the certain time t. Thereafter, the lift apparatus A and plug making machines 1 associated with conveyers No. 2–9 in the subsequent sections are stopped one after another as the certain time t passes.

It will be noted that, where conveyers Nos. 2–9 are kept in forward rotation only, the conveyer No. 1 becomes full in 25/9×the time t.

Therefore, the above construction significantly extends the period of time taken before the conveyer No. 1 becomes full. If the cause which makes the automatic packaging machine 2 inoperative is eliminated within this extended time and the packaging machine 2 is put into operation again, the lift apparatus A and the plug making machine 1 associated with the conveyer No. 1 may be kept operating all the time and the plugs on the conveyer No. 1 can be caused to return to the original level by increasing the processing speed of the automatic packaging machine 2.

The conveyers No. 1 and No. a may of course be driven only when plugs are delivered thereto during the time that the automatic packaging machine 2 remains out of operation.

| | No. 1 | No. 2 | No. 3 | No. 4 | No. 5 | No. 6 | No. 7 | No. 8 | No. 9 | No. a | Conveying Directions |
|---|---|---|---|---|---|---|---|---|---|---|---|
| Plug Levels | 9 | 8 | 7 | 6 | 5 | 4 | 3 | 2 | 1 | | ← |
| | 9 | 1 | 9 | 8 | 7 | 6 | 5 | 4 | 3 | 2 | → |
| | 11 | 10 | 9 | 8 | 7 | 6 | 5 | 4 | 1 | 2 | ← |
| | 11 | 1 | 11 | 10 | 9 | 8 | 7 | 6 | 5 | 4 | → |
| | 13 | 12 | 11 | 10 | 9 | 8 | 7 | 6 | 1 | 4 | ← |
| | 13 | 1 | 13 | 12 | 11 | 10 | 9 | 8 | 7 | 6 | → |
| | 15 | 14 | 13 | 12 | 11 | 10 | 9 | 8 | 1 | 6 | ← |
| | 15 | 1 | 15 | 14 | 13 | 12 | 11 | 10 | 9 | 8 | → |
| | 17 | 16 | 15 | 14 | 13 | 12 | 11 | 10 | 1 | 8 | ← |
| | 17 | 1 | 17 | 16 | 15 | 14 | 13 | 12 | 11 | 10 | → |
| | 19 | 18 | 17 | 16 | 15 | 14 | 13 | 12 | 1 | 10 | ← |
| | 19 | 1 | 19 | 18 | 17 | 16 | 15 | 14 | 13 | 12 | → |
| | 21 | 20 | 19 | 18 | 17 | 16 | 15 | 14 | 1 | 12 | ← |
| | 21 | 1 | 21 | 20 | 19 | 18 | 17 | 16 | 15 | 14 | → |
| | 23 | 22 | 21 | 20 | 19 | 18 | 17 | 16 | 1 | 14 | ← |
| | 23 | 1 | 23 | 22 | 21 | 20 | 19 | 18 | 17 | 16 | → |
| | 25 | 24 | 23 | 22 | 21 | 20 | 19 | 18 | 1 | 16 | ← |
| 1 Stopped | 25 | 0 | 25 | 24 | 23 | 22 | 21 | 20 | 19 | 18 | → |
| 2 Stopped | 25 | 25 | 25 | 24 | 23 | 22 | 21 | 20 | 1 | 18 | ← |
| 3 Stopped | 25 | 0 | 25 | 25 | 25 | 24 | 23 | 22 | 21 | 20 | → |
| 4 Stopped | 25 | 25 | 25 | 25 | 25 | 24 | 23 | 22 | 1 | 20 | ← |
| 5 Stopped | 25 | 0 | 25 | 25 | 25 | 25 | 25 | 24 | 23 | 22 | → |
| 6 Stopped | 25 | 25 | 25 | 25 | 25 | 25 | 25 | 24 | 1 | 22 | ← |
| 7 Stopped | 25 | 0 | 25 | 25 | 25 | 25 | 25 | 25 | 25 | 24 | → |
| 8 Stopped | 25 | 25 | 25 | 25 | 25 | 25 | 25 | 25 | 1 | 24 | ← |
| 9 Stopped | 25 | 0 | 25 | 25 | 25 | 25 | 25 | 25 | 25 | 25 | → |

While the invention is intended for solving the problem encountered in lifting and conveying cigarette filter plugs in multiple layers, the lift apparatus according to this invention may be utilized, as it is, for lifting cigarettes.

We claim:

1. A lift apparatus for lifting cigarette filter plugs and which receives filter plugs from a plug making machine while they are still uncured and delivered by a lower horizontal conveyor and conveys the plugs upwardly while they are piled in multiple layers to an upper horizontal conveyor, said lift apparatus comprising:

a pair of vertical spaced opposed flat belt conveyors disposed in fixed positions between the upper and lower horizontal conveyors, said vertical conveyors diverging from each other at a substantially uniform rate as they extend upwardly from the bottom to the top of the conveyors and defining a lifting passage therebetween the transverse size of which increases gradually from the bottom to the top of said lifting passage;

a pressurizing conveyor disposed at the lower end of said vertical conveyors and defining one side of a bend in a conveying passage extending from the lower horizontal conveyor into said lifting passage, said pressurizing conveyor being a flat belt having a run movable along the outer side of the bend; and a driving means connected to said pressurizing conveyor for driving said pressurizing conveyor at a greater speed than the speed of said vertical conveyors.

2. A lift apparatus as claimed in claim 1 in which said pressurizing conveyor drive means is a variable speed drive means, and further comprising drive means for said vertical conveyors which is a variable speed drive means.

3. A lift apparatus as claimed in claim 2 further comprising sensor means adjacent said vertical conveyors for sensing the amount of plugs being lifted and connected to said pressurizing conveyor drive means for varying the speed of said pressurized conveyor drive means in response to the amount of plugs being lifted.

4. A lift apparatus as claimed in claim 1 in which the lifting passage has a lower end having a width from 5 to 15 times the diameter of the plugs being lifted, and an upper end having a width 1.5 to 3 times the width of the lower end.

* * * * *